United States Patent [19]

Grothe

[11] Patent Number: 4,592,510

[45] Date of Patent: Jun. 3, 1986

[54] APPARATUS FOR SPRAYING A PROPELLANT-COOLANT MIXTURE UPON A CONTINUOUSLY CAST STRAND

[75] Inventor: Horst Grothe, Kaarst, Fed. Rep. of Germany

[73] Assignee: SMS Schloemann-Siemag Aktiengesellschaft, Düsseldorf, Fed. Rep. of Germany

[21] Appl. No.: 542,424

[22] Filed: Oct. 17, 1983

[30] Foreign Application Priority Data

Oct. 22, 1982 [DE] Fed. Rep. of Germany ..... 3239042

[51] Int. Cl.[4] ..... B22D 11/124

[52] U.S. Cl. ..... 239/432; 164/444; 164/348; 239/455; 239/498

[58] Field of Search ..... 164/444, 485–486, 164/443, 487, 348; 239/432, 455, 498, 502, 455

[56] References Cited

U.S. PATENT DOCUMENTS

| | | | |
|---|---|---|---|
| 1,469,392 | 10/1923 | Napolitan | 239/432 |
| 2,969,189 | 1/1961 | Jordan, Jr. | 239/455 |
| 3,183,664 | 5/1965 | Divone | 239/455 |
| 4,120,455 | 10/1978 | Wilmotte et al. | 164/444 |
| 4,424,855 | 1/1984 | Tsubakihara et al. | 164/444 |

FOREIGN PATENT DOCUMENTS

| | | | |
|---|---|---|---|
| 2103362 | 8/1972 | Fed. Rep. of Germany | 239/432 |
| 3004864 | 8/1981 | Fed. Rep. of Germany . | |
| 2096490 | 10/1982 | United Kingdom | 239/455 |

*Primary Examiner*—Nicholas P. Godici
*Assistant Examiner*—Richard K. Seidel
*Attorney, Agent, or Firm*—Werner W. Kleeman

[57] ABSTRACT

The apparatus for spraying a mixture of a propellant and a cooling agent onto a continuously cast strand, especially slabs, comprises guide means for the cooling agent including a spray nozzle, having a nozzle opening at the front side thereof in order to improve the cooling agent distribution. A narrow mixing chamber flow communicates with the spray nozzle and opens transversely with respect to the strand and with the formation of an angle. The spray nozzle opens approximately at the apex region of the mixing chamber. The cooling agent is discharged as a spray jet from the spray nozzle and gaseous propellant is conducted from a number of sides at an acute angle to the direction of the spray jet.

7 Claims, 4 Drawing Figures

APPARATUS FOR SPRAYING A PROPELLANT-COOLANT MIXTURE UPON A CONTINUOUSLY CAST STRAND

SUMMARY OF THE INVENTION

The present invention relates to a new and improved apparatus for spraying a mixture of a propellant and a cooling agent upon a strand, especially slabs, cast in a continuous casting mold.

In its more specific aspects the invention relates to a new and improved apparatus for spraying a mixture of a propellant and a cooling agent upon a strand, especially a cast steel slab, which has been cast in a continuous casting mold. Such spraying apparatus comprises a spray nozzle provided with a propellant supply line and a cooling agent or coolant supply line.

It is known for cooling cast strands to distribute a liquid cooling agent, for example, water in a gaseous propellant, for example, air, in order to accelerate the thus formed mixture through a distance of at least 100 mm and to spray the accelerated mixture through a spray nozzle in the form of a widely spread-out curtain or fan onto the strand surface.

A state-of-the-art cooling apparatus of the aforementinoned type and mode of operation is known, for example, from German Published Patent Application No. 3,004,864 and comprises a tube-shaped mixing chamber having an opening on the side thereof confronting the cast strand and a nozzle housing operatively connected to such opening. The mixing chamber has a further opening into which projects a tube insert which forms a cooling water infeed. The mixing chamber is laterally provided with a connector or connection stud for compressed air which serves as the propellant. The nozzle housing is provided with a segmental spherical-shaped impingement surface which is arranged in the direction towards the slab surface of the cast strand. Two prismatic discharge openings for the cooling medium are located opposite each other in the wall of the nozzle housing and in front of the impingement or impact surface. A swirl disk is arranged within the nozzle housing to provide for an intensive mixing of the cooling medium.

Due to the centrifugal action a separation may occur in the known apparatus at the segmental spherical-shaped impingement or impact surface, so that the distribution of the cooling liquid in the propellant gas during discharge of the mixture from the nozzle openings, and thus the uniform impingement upon the strand surface which should be achieved by the upstream arranged swirl disk, are no longer insured for to the full extent. A further disadvantage of the known device resides in the formation of a so-to-speak blind spraying sector or region on the front side of the nozzle, whereby there is prevented the formation of an uninterrupted spray curtain or fan across the entire width of the slab strand. To compensate for such spraying deficiencies nozzles are successively arranged at a lateral offset. By virtue of such an arrangement, however, there is precluded a precise adjustment of the width of the spraying curtain or fan relative to the momentarily encountered strand width, and thus, a rational utilization of the cooling agent mixture.

SUMMARY OF THE INVENTION

Therefore, with the foregoing in mind it is a primary object of the present invention to provide a new and improved apparatus for spraying a mixture of a propellant and a cooling agent upon a strand cast in a continuous casting mold and which is not afflicted with the aforementioned drawbacks and limitations of the prior art spraying and cooling apparatus.

Another important object of the present invention is directed to the construction of a new and improved apparatus for spraying a mixture of a propellant and a cooling agent upon a strand cast in a continuous casting mold, and which apparatus is relatively simple in its structure and design, extremely reliable in its operation, and by means of which a liquid cooling agent can be uniformly distributed in a gaseous propellant in the form of very fine droplets and can be sprayed onto a cast strand surface between adjacent strand guiding rolls at high rates and in the form of a continuous curtain or fan.

Still a further significant object of the present invention is directed to a new and improved apparatus for spraying a mixture of a propellant and a cooling agent onto a strand cast in a continuous mold which enables an improved adjustment of the mixing ratio and of the curtain width with respect to the casting material or cast metal, the cross-section of the casting, the casting rate and the growth of the frozen layer or skin on the cast strand or casting.

Now in order to implement these and still further objects of the invention, which will become more readily apparent as the description proceeds, the apparatus of the present development is manifested by the features that, cooling liquid guide means including a spray nozzle at the front side thereof open approximately at an apex region of a narrow mixing chamber which opens up transversely relative to the strand and with the formation of an angle, and the propellant is directed at an acute angle from a number of sides upon the cooling liquid jet which is discharged from the spray nozzle.

Due to the elimination of an impingement or impact surface on the side of the strand there are prevented voids in the spraying curtain or fan as well as also a disadvantageous separation or de-mixing. Using the novel apparatus according to the invention the cooling agent can be finely and uniformly distributed and continuously sprayed onto the slab strand surface in the form of a curtain or fan corresponding to the slab strand width without employing a specific acceleration path for the cooling agent mixture. An improvement in the reliability of operation results inasmuch as in the event of failure of the propellant supply there is still present a sufficient cooling action due to the cooling liquid which is sprayed in the form of a curtain onto the strand surface.

For improving the cooling agent distribution and for obtaining an optimum cooling agent impingement upon the momentarily encountered cast strand a number of mixing or flow obstructions assisting in the mixing operation can be arranged in the mixing chamber. The flow obstructions can be designed as pins and by varying the number and the position of these pins there is beneficially possible an adaptation to variable strand formats and strand qualities.

A particularly simple design of the apparatus according to the invention results when a nozzle tube is arranged in a housing which is provided with a propellant gas connection. The nozzle tube and the housing including intermediately arranged propellant passages or openings conically taper towards the spray nozzle. The mixing chamber is formed by walls of the housing.

In a further development of the inventive apparatus the boundary or limiting walls of the mixing chamber are positioned at an angle with respect to each other and can be designed in the form of adjustable baffle plates for adaptation of the cooling curtain or fan to variable slab widths. Advantageously, such adjustment is achieved by mounting the baffle plates relative to or upon an axis, the prolongation or extension of which approximately extends through the nozzle opening. A pressure fluid cylinder may be provided as a pivot drive means for the baffle plates.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
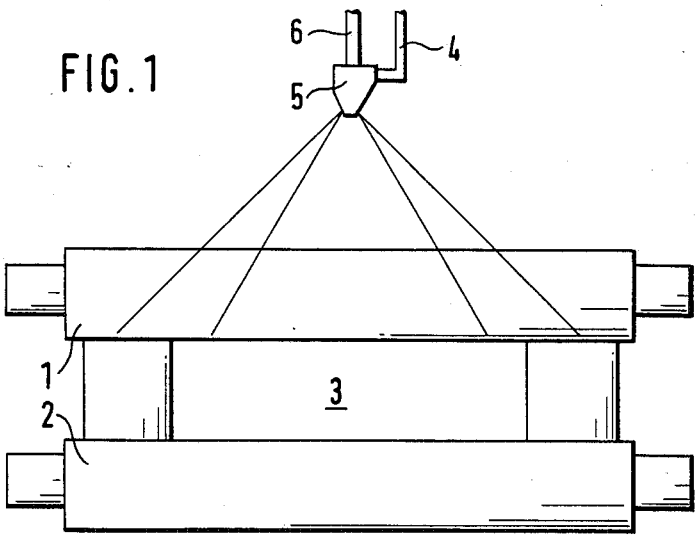
FIG. 1 is a schematic view showing the arrangement of the spraying and cooling apparatus according to the invention located above a cast strand.

Describing now the drawings, it is to be understood that only enough of the construction of the spraying and cooling apparatus has been shown as needed for those skilled in the art to readily understand the underlying principles and concepts of the present development, while simplifying the showing of the drawings. Turning attention now specifically to FIG. 1, there has been schematically illustrated therein a spraying and cooling apparatus for cooling a cast strand 3, here a slab, guided by supporting rolls 1, 2. In the showing of FIG. 1 the spraying and cooling apparatus—sometimes briefly spraying apparatus—is arranged in the projection of the space or region between the supporting rolls 1, 2 taken perpendicular to the strand surface. The spraying and cooling apparatus comprises a housing 5 provided with a lateral propellant supply line or conduit 4 which conducts, for instance, compressed air as the propellant. Within the interior space or chamber of the housing 5 there is arranged a nozzle tube or pipe 7 in such a manner as to form an annular space 8, as best seen by referring to FIG. 2. The nozzle tube 7 is connected to a cooling agent supply line or conduit 6 which may conduct, for instance, water as the cooling agent. The housing 5 and the nozzle tube 7, defining a spray nozzle, are conically tapered towards a spray nozzle opening or orifice 9. Propellant passages or channels 10 are formed between cooperatively associated walls 40 of the housing 5 and nozzle tube 7 and are directed towards the discharge or outlet region of the spray nozzle opening 9.

Figure 2:
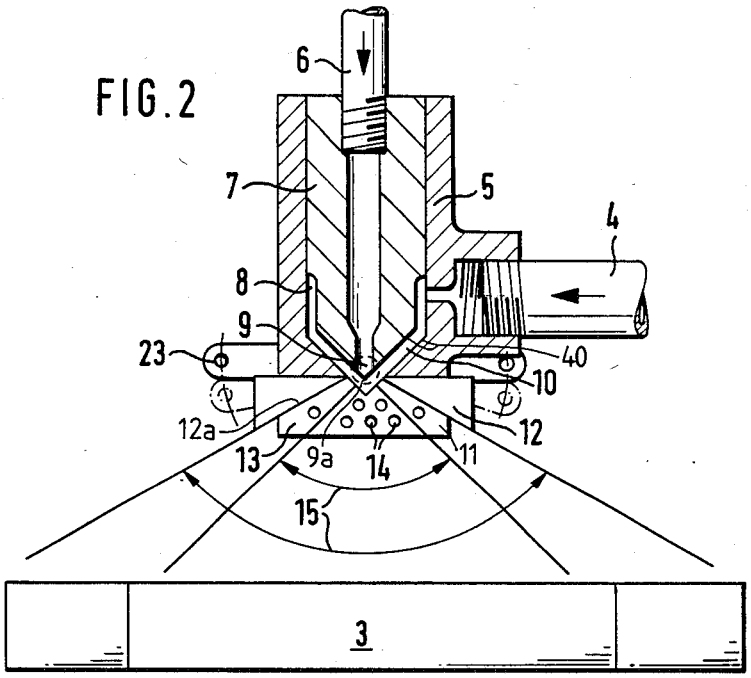
FIG. 2 is a longitudinal section through the apparatus shown in FIG. 1.
Figure 3:
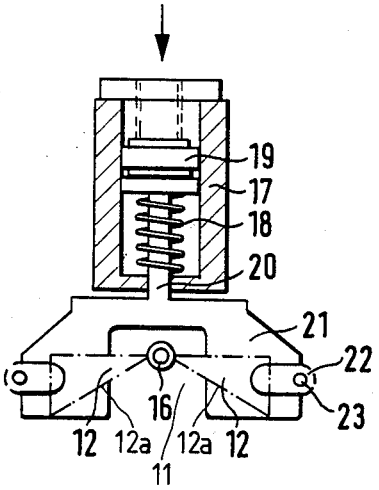
FIG. 3 is a longitudinal section of a pivot drive for the guide or baffle plates employed in the apparatus shown in FIG. 2.
Figure 4:
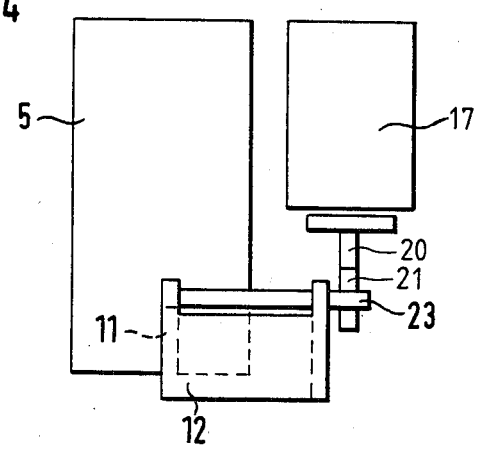
FIG. 4 schematically illustrates the relative arrangement of the spraying and cooling apparatus shown in FIG. 2 and the pivot drive shown in FIG. 3.

Walls 13 of the housing 5 extend beyond the region defined by the spray nozzle opening or jet opening 9 through which a liquid jet is discharged during operation of the spraying and cooling apparatus. A narrow mixing chamber 11 is formed in front of the spray nozzle opening 9 and extends transversely with respect to the cast strand or slab 3, as shown in FIGS. 2 and 3. On both sides the mixing chamber 11 is bounded by baffle or guide plates 12, the edges 12*a* of which extend so as to form an angle with each other. The spray nozzle opening 9 is structured to form a slot 9*a* which extends parallel to the mixing chamber 11.

Pins 14 are inserted into the walls 13 and span the mixing chamber 11, thus forming flow obstructing means or mixing resistances assisting in promoting the mixing operation. In this way a narrow mixing chamber 11 is formed which opens towards the cast strand 3 and which forms an angle in front of the spray nozzle opening 9. These pins 14 can be varied with respect to their number and position by inserting a desired number thereof into given ones of their receiving openings 14*a*. A spray curtain or fan 15 which is defined by the baffle or guide plates 12 is discharged from the angular or wedge-shaped mixing chamber 11 precisely towards the momentarily encountered slab width.

For adapting the spray curtain or fan 15 to changing slab widths and in order to be able to vary the spray curtain angle the baffle or guide plates 12 are pivotally mounted to a shaft or axle 16 which is secured at the housing 5 laterally of the spray nozzle opening 9. Pivot drive means are formed, for instance, by a fluid-operated pressure cylinder 17 mounted at the housing 5. A piston 19 reciprocatable in the pressure cylinder 17 acts against the force of a spring 18 or equivalent structure and is connected via a piston rod 20 to a guide element or piece 21. On its sides this guide element or piece 21 is provided with open slots or recesses 22 for accommodating bolts 23 which are mounted at the baffle or guide plates 12.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for spraying a mixture of a gaseous propellant and a liquid cooling agent onto a strand, especially a steel slab, cast in a continuous casting mold, comprising:

a propellant supply line;

a cooling agent supply line;

a spray nozzle containing a spray nozzle opening;

said propellant supply line and cooling agent supply line cooperating with said spray nozzle;

a narrow mixing chamber defining an apex region;

said narrow mixing chamber being arranged so as to extend transversely relative to the strand and laterally opening at an adjustable angle towards said strand;

said spray nozzle opening flow-communicating with said cooling agent supply line and being arranged approximately at said apex region of said mixing chamber;

said spray nozzle, when in operation, discharging a liquid cooling agent jet through said spray nozzle opening; and said spray nozzle being provided with means cooperating with said propellant supply line for directing the gaseous propellant at an acute angle and from a number of sides towards said liquid cooling agent jet discharged from said spray nozzle opening in order to thereby form a spray curtain covering substantially the width of said strand.

2. The apparatus as defined in claim 1, further including:

flow obstructing means arranged in said mixing chamber to promote the admixing of the gaseous propellant and liquid cooling agent.

3. The apparatus as defined in claim 2, wherein:

said flow obstructing means comprise pins; and said pins being variable in respect of number and position.

4. The apparatus as defined in claim 1, further including:

a housing comprising walls;

said spray nozzle including a nozzle tube arranged in said housing;

said spray nozzle having a spray nozzle opening;

said housing and said nozzle tube conically tapering towards said spray nozzle opening;

said means cooperating with said propellant supply line comprising a number of propellant passages arranged intermediate said housing and said nozzle tube; and said mixing chamber possessing divergent angular shape which opens towards said strand and being formed by said walls of said housing.

5. The apparatus as defined in claim 4, wherein:

said mixing chamber comprises means defining said divergent angular shape; and said means defining said angular shape comprising angularly adjustable baffle plates.

6. The apparatus as defined in claim 5, further including:

a pivot shaft for pivotably mounting said baffle plates; and an imaginary extension of said pivot shaft approximately extending through said spray nozzle opening.

7. The apparatus as defined in claim 6, further including:

a fluid-operated pressure cylinder for pivoting said baffle plates; and a guide element operatively connecting said fluid-operated pressure cylinder with said baffle plates.

* * * * *